US008651838B2

(12) United States Patent
Birkenstock et al.

(10) Patent No.: US 8,651,838 B2
(45) Date of Patent: Feb. 18, 2014

(54) VACUUM PUMP WITH CONTROL UNIT

(75) Inventors: Timo Birkenstock, Herborn (DE); Dirk Hopf, Schöffengrund (DE); Tobias Stoll, Angelburg (DE)

(73) Assignee: Pfeiffer Vacuum GmbH, Asslar (DE)

( * ) Notice: Subject to any disclaimer, the term of this patent is extended or adjusted under 35 U.S.C. 154(b) by 980 days.

(21) Appl. No.: 11/729,767

(22) Filed: Mar. 28, 2007

(65) Prior Publication Data

US 2007/0237650 A1 Oct. 11, 2007

(30) Foreign Application Priority Data

Apr. 7, 2006 (DE) ..... 10 2006 016 405

(51) Int. Cl.
*F04B 35/04* (2006.01)
*H01R 12/00* (2006.01)
*H05K 1/00* (2006.01)

(52) U.S. Cl.
USPC ..... 417/423.4; 439/65

(58) Field of Classification Search
USPC ..... 417/44.2, 423.4, 423.14, 44.1, 424.1, 417/363, 423.15, 423.1, 422; 439/76.1, 439/198, 276, 559, 908, 76.2, 587
See application file for complete search history.

(56) References Cited

U.S. PATENT DOCUMENTS 4,023,920 A * 5/1977 Bachler et al. ..... 417/354
4,780,086 A * 10/1988 Jenner et al. ..... 439/42
4,797,007 A * 1/1989 Elmore, III ..... 374/143
4,804,330 A * 2/1989 Makowski et al. ..... 439/76.1
5,061,193 A * 10/1991 Seaman ..... 439/76.1
5,152,676 A * 10/1992 Ohi ..... 417/354
5,247,424 A * 9/1993 Harris et al. ..... 361/704
5,393,931 A * 2/1995 Guenther ..... 174/547
5,650,678 A * 7/1997 Yokozawa et al. ..... 310/90
5,971,725 A * 10/1999 de Simon et al. ..... 417/423.8
6,155,856 A * 12/2000 Sanada ..... 439/246
6,305,975 B1 * 10/2001 Steiner ..... 439/559
6,316,768 B1 * 11/2001 Rockwood et al. ..... 250/287
6,323,663 B1 * 11/2001 Nakata et al. ..... 324/756.03
6,350,964 B1 * 2/2002 Boas et al. ..... 219/390
6,465,729 B2 * 10/2002 Granoff et al. ..... 174/18
6,575,713 B2 * 6/2003 Ohtachi et al. ..... 417/353
6,644,938 B2 * 11/2003 Omori ..... 417/353
6,793,466 B2 * 9/2004 Miyamoto ..... 417/313
6,815,855 B2 * 11/2004 Yashiro et al. ..... 310/90
6,902,378 B2 * 6/2005 Gaudet et al. ..... 417/27

(Continued)

FOREIGN PATENT DOCUMENTS

DE 2119857 11/1972
EP 0597365 5/1994

(Continued)

OTHER PUBLICATIONS

English Translation of Office Action.

*Primary Examiner* — Devon Kramer
*Assistant Examiner* — Alexander Comley
(74) *Attorney, Agent, or Firm* — Abelman, Frayne & Schwab

(57) ABSTRACT

A vacuum pump that includes a housing, a control unit including control elements for controlling electronic and electrical components located in the inner chamber of the housing, and a separation member for separating the inner chamber in which an underpressure prevails, from an environment in which the vacuum pump is located and including a printed circuit board having elements for conducting electrical current and voltage in the inner chamber of the pump housing.

14 Claims, 3 Drawing Sheets

(56) References Cited

U.S. PATENT DOCUMENTS

| | | | | |
|---|---|---|---|---|
| 6,991,439 | B2 * | 1/2006 | Ishikawa | 417/423.4 |
| 2003/0175131 | A1 * | 9/2003 | Ishikawa | 417/353 |
| 2005/0058559 | A1 * | 3/2005 | Kasahara et al. | 417/423.7 |
| 2005/0196285 | A1 * | 9/2005 | Jayanth | 417/44.11 |
| 2007/0132327 | A1 * | 6/2007 | Brunet | 310/90.5 |

FOREIGN PATENT DOCUMENTS

| | | |
|---|---|---|
| JP | 08-338393 | 12/1996 |
| JP | 2006-090251 | 4/2006 |
| JP | 2006-250033 | 9/2006 |

* cited by examiner

VACUUM PUMP WITH CONTROL UNIT

BACKGROUND OF THE INVENTION

1. Field of the Invention

The present invention relates to a vacuum pump including a housing having an inner chamber, a control unit including control elements for controlling electronic and electrical components located in the inner chamber of the housing, and a separation member for separating the inner chamber in which an underpressure prevails, from an environment in which the vacuum pump is located.

2. Description of the Prior Art

In vacuum pumps of the type described above, electronic and electrical components, which are located in the housing inner chamber includes, e.g., electrical windings of a motor or Hall probes that detect the rotation of the shaft and the like. The components, which are arranged within the vacuum pump, are controlled by control elements located outside of the vacuum pump. These control elements are often located in a control unit. The inner chamber of such vacuum pumps is subjected to pressure that is below the atmospheric pressure.

This means that the electrical conductors that provide an electrical connection between the components, which are located in the inner chamber, and the electronic control elements, which are located outside of the vacuum pump, must be guided through hermetically sealed leadthroughs from the inner chamber to the outside.

The conventional solution of the state of the art consists in the provision of a hermetically sealed plug on the vacuum pump. The plug has pins extending into the inner chamber of the vacuum pump and to which wires, which lead to the components, are soldered. In the last years, the size and the shape of the vacuum pump play a greater and greater role. Though the desired function of the vacuum pump and the control unit are important, the combined system should generally be compact. The control unit should be adapted to the housing of the vacuum pump and, thus, should be formed taking into account the shape of the pump housing. In other words, the housing of the vacuum pump sets the basic parameters of the control unit. With this, the plug, which is used in the state of the art pumps, presents a drawback as it complicates the designing of the control unit and occupies a large space.

Accordingly, an object of the present invention is to provide a vacuum pump with a separation member between the inner chamber and the surrounding environment which would ensure a vacuum-tight leadthrough the conducting means which is susceptible to fewer mounting errors and which would provide for a flexible realization of electrical signal communication.

SUMMARY OF THE INVENTION

This and other objects of the present invention, which will become apparent hereinafter, are achieved by providing a vacuum pump, the separation member of which includes a printed circuit board having means for conducting electrical current and voltage in the inner chamber of the pump housing. Due to the fact that the separation member includes a printed circuit board the signal communication can be substantially better adapted to the spacial conditions. The placement of components in the printed circuit board is much simpler and less error-prone during assembly because of generous spacial conditions. It is possible, to transfer a signal on the board from the point of application to another point of the board, and to provide a connection from this point to the control unit. The boards themselves contain a wider band with of geometrical forms, which is very cost-effective. In addition, they are sufficiently vacuum-tight.

A first modification relates to the formation of means for guiding through currents and voltage. A technically simple and cost-effective solution consists in drilling bores through the printed circuit board, insertion of pins in the formed bores, and soldering the pins therein. The soldering insures a vacuum-tight leadthrough.

Another modification of means for guiding electrical currents and voltages through the printed circuit board consists in the provision of a hermetically sealed plug in the printed circuit board. The plug has contact pins extending into the interior of the vacuum pump. At their sides remote from the vacuum pump interior, the contact pins are soldered into the printed circuit board. With this embodiment the vacuum tightness is increased even further.

According to a further modification of the invention, the printed circuit board is formed of at least two layers. This permits to provide a plug connector on the outer surface of the printed circuit board, with the plug connector being electrically connected with an electrically conducting layer located between the two layers of the printed circuit board. This prevents the formation of the through-bores in the printed circuit board for leadthroughs for conducting the electrical currents and voltages through the printed circuit board. This also substantially increases the vacuum tightness of the arrangement.

The arrangement of an elastomeric ring in the gap between the separation member and the housing permits to achieve a simple and reliable seal. This can be further improved be providing a coating on the side of the printed circuit board on which the elastomeric ring is placed. This coated surface is formed flat which prevents the formation of points which would not be engaged by the elastomeric ring sufficiently tightly. The coating can be formed of gold or a gold alloy. Such coatings are conventional in the manufacturing process of printed circuit boards and are, therefore, economical.

Provision of further electronic components on the printed circuit board permits to provide additional functions in the vacuum pump without arrangement of additional electronic components in the underpressure region, in the interior of the vacuum pump. Functions such as memory, failure recognition of a pump type, temperature measurement, and the like can be developed, without conducting electrical signals through a vacuum-tight leadthrough. Only unavoidable conductors are guided in the vacuum region of a vacuum pump, e.g., those for the motor. All other conductors can be provided on the printed circuit board which is more simple technically and more economical. In addition, the number of the electronic components, which operate in the underpressure region, is minimized.

In accordance with a further development of this idea, a temperature sensor, which has a thermal contact with the pump housing, is arranged on the printed circuit board. The thermal contact of the temperature sensor with the housing can be realized by a direct mechanical contact of the sensor with the housing. Another solution consists in the provision of a mechanically deformable thermal conductor between the temperature sensor and the housing. This avoids expensive cabling of the sensor in the interior of the vacuum pump and permits to easily replace a defective temperature sensor. In this way a reliable monitoring of the pump temperatures is ensured and, thereby, extremely high pump temperatures can be reliably prevented.

According to an advantageous embodiment of the invention, the control unit is releasably secured on the vacuum pump, with the separation member being at least partially covered by the control unit. Thereby, a compact vacuum pump system is provided, with the separation member being protected from outside influences. The invention proves to be particularly advantageous for turbomolecular pumps which have an especially large number of electronic components and require an expensive control.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiments when read with reference to the accompanying drawings.

DETAILED DESCRIPTION OF THE PREFERRED EMBODIMENTS

Figure 1:
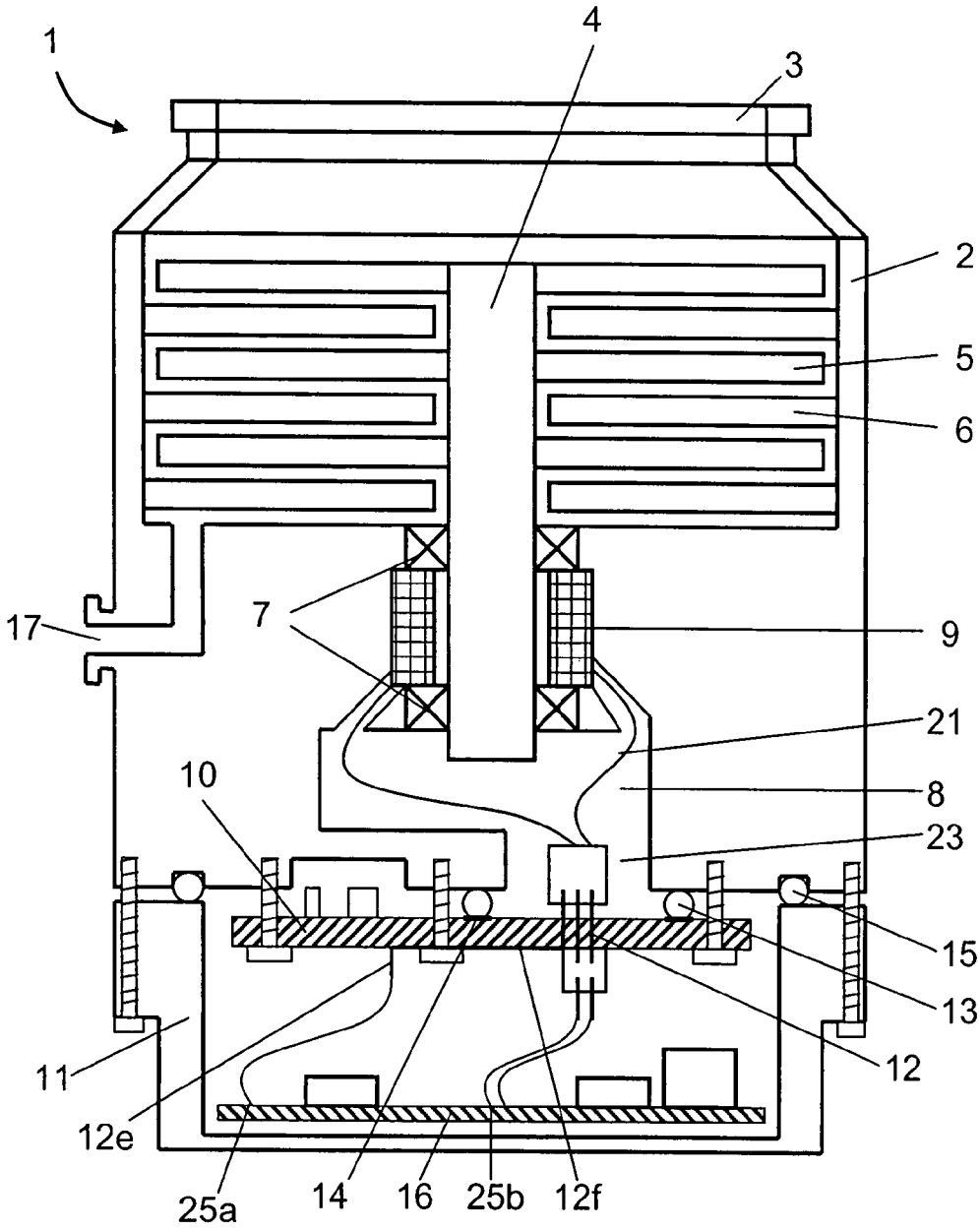
FIG. 1 a cross-sectional view of a turbomolecular pump with a control unit according to a first embodiment of the present invention.

FIG. 1 shows a turbomolecular vacuum pump 1, in short turbopump, as an example of a vacuum pump. The turbopump includes a suction flange 3 that connects the turbopump with a recipient in which a high vacuum should be produced. The aspirated gas is compressed with vane-carrying rotor discs 5 and stator discs 6. The rotor discs 5 are rapidly rotated by a shaft 4 on which they are fixedly secured. The compressed gas, which still has a pressure in the low/high vacuum region, is fed through a gas outlet 17 to a forevacuum pump. The shaft 4 is rotatably supported by bearings 7 which are formed, e.g., as ball bearings or magnetic bearings. The shaft 4 is rotated by a drive motor 9. The turbopump has an inner chamber 8 in which in comparison with the pump environment, underpressure prevails (hereinafter vacuum chamber). This underpressure lies in the forevacuum region that exists at the gas outlet 17 because the vacuum chamber 8 and the gas outlet 17 are connected with each other by the motor 9 and the bearing clearance. In the vacuum chamber 8, electrical conductors, through which electrical power necessary for producing rotation is fed to the motor 9, are arranged.

At the end of the turbopump opposite the suction flange 3, there is provided a control unit 11 which is releasably connected, e.g., by screws, with the turbopump housing. In the control unit 11, electronic control elements 16 are provided. These control elements take over multiple tasks, e.g., generating current and voltage for controlling the motor coils. Use of a network voltage can also be provided for. To this end, integrated control elements and/or controllers can be provided which control the peripheral units such as, e.g., a ventilator and the like. Also, operational data of the turbopump can be monitored or flow processes and the like can be controlled. The housing 4 can be sealed with an outer seal 15. Thereby, it is possible to protect electronic control elements from spray water, but the outer seal does not serve for obtaining a vacuum tightness.

The control unit and its environment are subjected to the same environmental condition, i.e., under normal conditions, the atmospheric pressure prevails. From the control elements 16, electrical current and voltage is fed into the vacuum chamber 8 of the turbopump. Therefore, the pressure difference between the surrounding environment and the vacuum chamber 8 should be maintained. To this end, there is provided a separation member which is equipped with means 12 for conducting electrical current and voltage and which covers an opening 23 in the housing of the turbopump. A section of the separation member is formed as a printed circuit board 10. The printed circuit board 10 is drilled through in separate locations. Through the drilled bores, electrically conducting pins are inserted and soldered in the bores, so that the bores become closed vacuum-tightly. The electrically conducting pins are connected, at their side adjacent to the control unit 11, with electrical conductors which establish their electrical contact with the control elements 16. These conductors ends at different, spaced from each other, contact points 25*a*, 25*b*. Instead of a direct connection of the electrically conducting pins with the electrical conductors, for a portion of necessary connections, a conducting track 12*f* can be provided, through which the electrical current and voltage is fed to another point of the printed circuit board 10. This provides for an optimal, flexible spacial arrangement of different control points in the control unit. For establishing contact between the conductors and electrically conducting pins, e.g., simple contact plugs can be used. At the side of the electrically conducting pins adjacent to the vacuum chamber 8, plugs are pinned on the electrically conducting pins. At the ends of the pinned-on plugs, there are provided conductors 21 that lead to the electrical components in the vacuum chamber 8 of the turbopump, e.g., to the motor. Such contact plugs simplify mounting of the separation member on the pump and dismounting of the separation member. The printed circuit board 10 of the separation member is screwed to the pump housing 2 with screws. In order to increase the vacuum tightness of the arrangement, the opening 23 in the housing 2, which is closed by the separation member, is surrounded with an elastomeric seal 13. The vacuum tightness can be further improved by provision of a coating 14 in the region in which the elastomeric seal abuts the printed circuit board 10.

Figure 2:
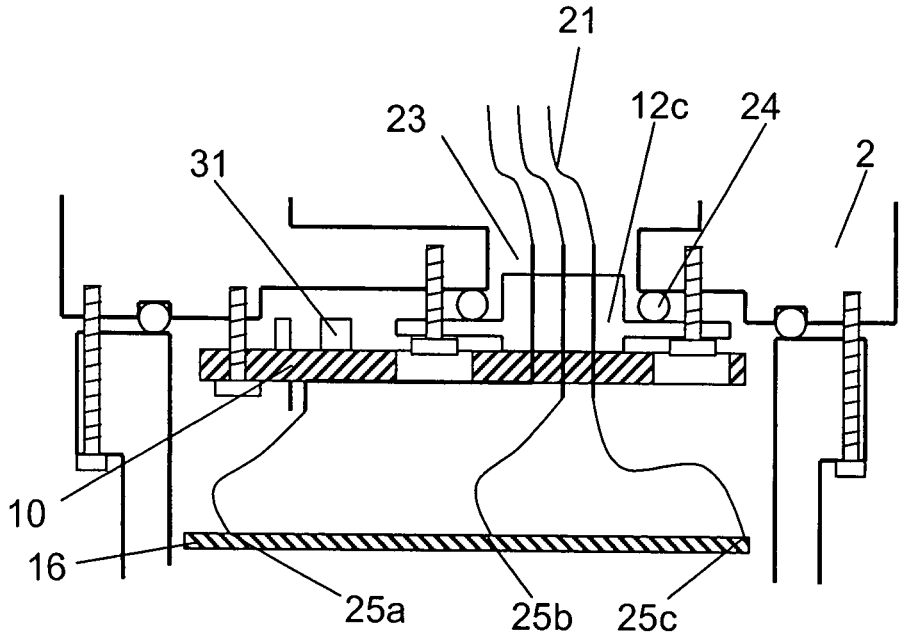
FIG. 2 a cross-sectional view of the region of the separation member between the inner chamber of the vacuum pump and the environment according to a second embodiment of the present invention.

A second embodiment of a separation member is shown in FIG. 2 in which only a lower portion of the turbopump and the upper portion of the control unit are shown. The separation member has a printed circuit board 10 and a hermetically sealed plug 12*c* that forms means for conducting electrical current and voltage. The plug 12*c* has a plurality of contact pins that extend into the bores in the printed circuit board 10 and are soldered there. The contact pins extend at the side adjacent to the opening 13 and are connected there with conductors 21. An elastomeric seal 24 is arranged between the contact plug 21*c* and the housing 2 of the turbopump and seals the inner chamber. In order to ensure the mechanical reliability and vacuum tightness, the plug is screwed together with the housing. The printed circuit board 10 is also releasably connected with the pump housing 2 by screws. On the printed circuit board 10, there are provided further electronic components 31. Those can be served, e.g., for storing pump-related data such as pump type, serial number, etc.

Figure 3:
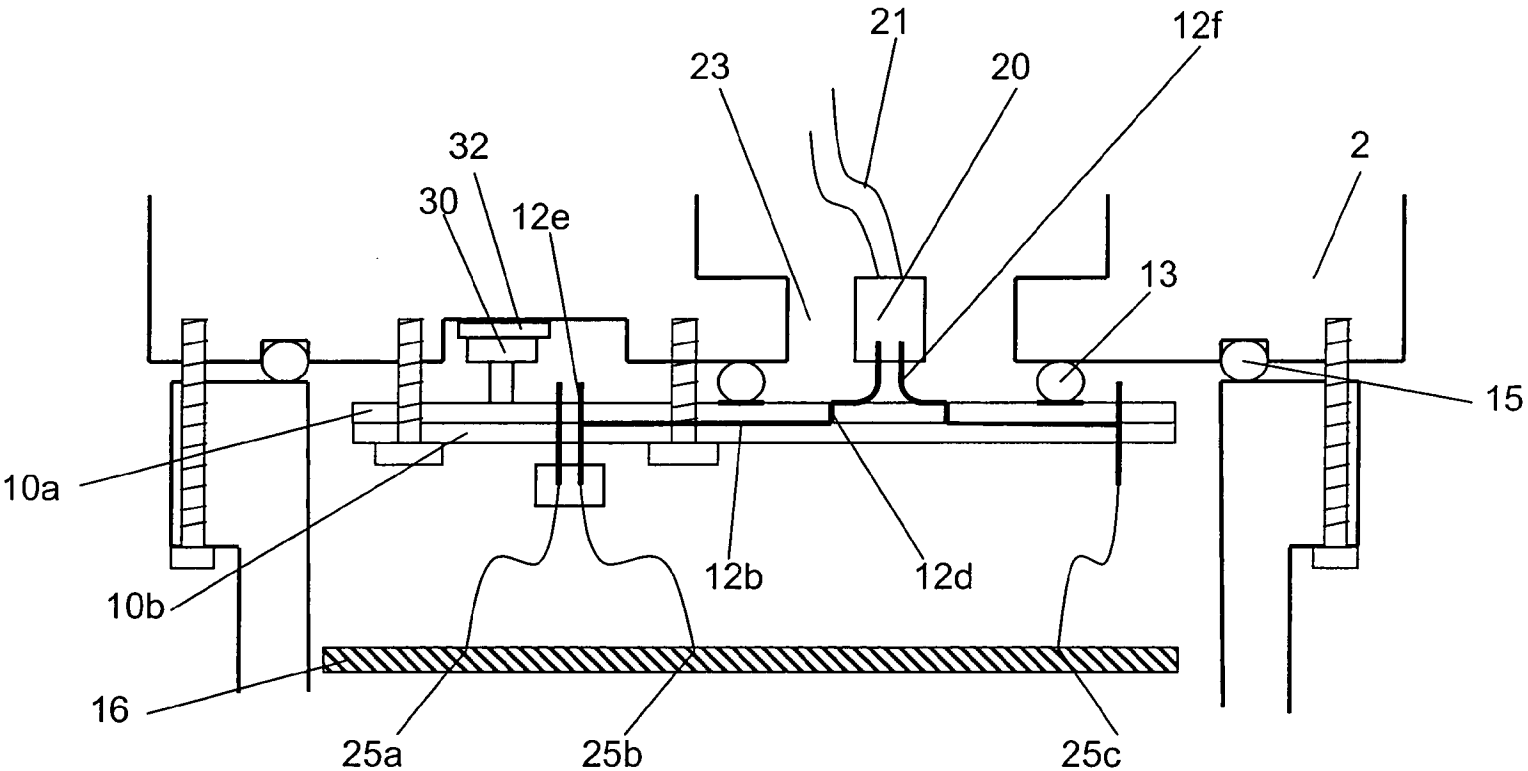
FIG. 3 cross-sectional view of the region of the separation member between the inner chamber of the vacuum pump and the environment according to a third embodiment of the present invention.

A further embodiment of an inventive separation member is shown in FIG. 3 in which again only the lower portion of the pump and the upper portion of the control unit are shown. The printed circuit board 10, which forms parts of the separation member, is formed of two layers 10*a* and 10*b*. However, the printed circuit board can be formed of a greater number of layers. Between the layers, there is provided an inner electrically-conducting layer, i.e., between the layers 10*a* and 10*b*, a conducting track is formed. The means for conducting the electrical current and voltage also includes a plug connector 12*f* mounted on the surface of the printed circuit board and which is formed, e.g., using the surface mounting technology (SMT-technology). The plug connector 12*f* is mounted in the underpressure region of the printed circuit board. The requirements for the mechanical stability in this region are low. Generally, a surface mounting device (SMD-plug) can be provided there, where no high mechanical stability is needed. Onto the plug connector 12*f*, a mating plug 20 is pinned. Conductors 21, which lead to electrical and electronic components in the inner chamber of the turbopump, are provided at the end of the plug 20 adjacent to the inner chamber. Blind bores 12*d*, which extend only through one of the layers 12*a*, 12*b*, form an electrical connection with the conductor track 12*b* provided between the layers 10*a*, 10*b*, From the conducting track, further electrical connections can be formed through other blind bores provided in the surface of the printed circuit board adjacent to the control unit. When a plug connector has to be used on the surface of the printed circuit board adjacent to the control unit, the electrical current and voltage is conducted from the region of the elastomeric ring 13 over the conducting track 12*b* and to the pins 12*e* soldered in respective bores. The conducting track 12*b* ends then in a region in which there is no difference between pressures applied, respectively, to surfaces of layers 10*a* and 10*b* and no surface is subjected to underpressure. In this region throughbores can be formed without any problems. It is thereby possible to form mechanically strongly loaded plug connections for connections to the control elements 16. With measures provided in this embodiment, it is possible to eliminate bores which would have extended through the entire printed circuit board in the vacuum critical region inside of the elastomeric ring 13. The vacuum tightness of the separation member in this embodiment is very high. Simultaneously, it is easily possible to so lay out the conducting tracks between the layers that the contacts lead to the contact points 25*a*, 25*b*, 25*c* on the side of the control unit which are located spacially adjacent to the parts of the control elements in the control unit.

On the printed circuit board, a temperature sensor 30 is provided. The temperature sensor 30 permits a reliable monitoring of the pump temperature so that too high operations temperatures can be detected, and counter measures can be taken. E.g., the power of the control can be reduced or the pump can be stopped altogether. The temperature sensor 30 has a thermal contact with the housing 2. This contact can be achieved in different ways. It is possible to bring the temperature sensor in a direct contact with the housing, pressing it thereagainst. It is also possible to provide good thermally conducting means 32 between the temperature sensor 30 and the housing 2. It is advantageous to form the means 32 mechanically elastically deformable to ensure a reliable thermal transition from the temperature sensor to the thermal conducting means 32 and therefrom to the housing.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A vacuum pump for producing high vacuum in a recipient, the vacuum pump comprising: a housing provided at one end thereof with a flange for connecting the vacuum pump with the recipient and having a vacuum chamber in which pumping elements for compressing gas are located; electrical and electronic components located in the vacuum chamber; a control unit provided at another end of the housing opposite the one end and including control elements for controlling the electrical and electronic components located in the vacuum chamber; a separation member provided on the another end of the housing for separating the vacuum chamber from an environment in which the vacuum pump is located and formed as a printed circuit board having an outer surface facing the control unit and an inner surface facing the vacuum chamber; and means for conducting electrical current and voltage from the control elements to the electrical and electronic components for controlling same, the conducting means including at least one electrical component mounted on one of the outer and inner surfaces of the printed circuit board.

2. A vacuum pump according to claim 1, wherein the control unit is releasably secured to the housing and surrounds the separation member.

3. A vacuum pump according to claim 1, wherein the surface-mounted electrical component is formed as a plug connector mounted on the inner surface of the printed circuit board.

4. A vacuum pump according to claim 3, wherein the conducting means further comprises a plug secured on the plug connector and provided at an end thereof remote from the plug connector with conductors leading to the electric and electronic components located in the vacuum chamber.

5. A vacuum pump according to claim 3, wherein the printed circuit board has at least two layers, and wherein the plug connector is electrically connected with an electrically conducting interface layer between the at least two layers.

6. A vacuum pump according to claim 5, wherein the conducting means includes a pin soldered in a bore in the printed circuit board and connecting the electrically conducting interface layer with a power source.

7. A vacuum pump according to claim 1, wherein the surface-mounted electrical component is formed as a conducting track mounted on the outer surface of the printed circuit board.

8. A vacuum pump according to claim 1, wherein the surface-mounted electrical component is formed as a hermetically sealed plug mounted on the inner surface of the printed circuit board.

9. A vacuum pump according to claim 1, further comprising an elastomeric ring for sealing the separation member relative to the housing.

10. A vacuum pump according to claim 9, wherein the elastomeric ring abuts a coated surface of the separation member.

11. A vacuum pump according to claim 1, wherein the separation member has, on a side thereof adjacent to the housing, at least one further electronic component extending between the separation member and the pump housing.

12. A vacuum pump according to claim 11, wherein the at least one further electronic component is a temperature sensor having a thermal contact with the pump housing.

13. A vacuum pump according to claim 1, wherein the control unit is releasably secured on the vacuum pump and at least partially covers the separation member.

14. A vacuum pump according to claim 1, wherein the vacuum pump is formed as a turbomolecular pump.

* * * * *